US005110124A

United States Patent [19]

Micco

[11] Patent Number: 5,110,124

[45] Date of Patent: May 5, 1992

[54] BLANKET FOR PEEWEE FOOTBALL BLOCKING AND TACKLING DUMMY

[76] Inventor: James Micco, 2 Hanson Pl., Huntington, N.Y. 11743

[21] Appl. No.: 710,746

[22] Filed: May 31, 1991

[51] Int. Cl.[5] ..... A63B 67/00

[52] U.S. Cl. ..... 273/55 A

[58] Field of Search ..... 273/55 R; 272/76, 77, 272/78

[56] References Cited

U.S. PATENT DOCUMENTS

| | | | |
|---|---|---|---|
| 2,929,629 | 3/1960 | Feula | 273/55 R |
| 3,680,861 | 8/1972 | Schmidt | 273/55 R |
| 3,700,237 | 10/1972 | Kopp | 273/55 A |
| 3,866,909 | 2/1975 | De Santo | 272/76 |
| 3,907,291 | 9/1975 | Parker | 273/55 R |
| 4,824,414 | 4/1989 | Goldblatt | 273/55 A |
| 4,869,503 | 9/1989 | Grasso | 273/55 A |
| 4,974,833 | 12/1990 | Hartman | 272/76 |

*Primary Examiner*—Theatrice Brown
*Attorney, Agent, or Firm*—Richard L. Miller

[57] ABSTRACT

A peewee blanket assembly for a football blocking and tackling dummy is provided and consists of a rectangular shaped blanket member having a plurality of spaced apart eyelets along each long side edge thereof. A cord for lacing the eyelets on each opposite long side edge so that the blanket member can wrap around an existing tackling dummy. A full length standing picture of a football player is in the middle on the front surface of the blanket member. A mechanism is within the middle rear surface of the blanket member, for indicating the strength of force when a user typically a young boy tackles the blanket member on the existing blocking and tackling dummy properly in a target area.

4 Claims, 1 Drawing Sheet

BLANKET FOR PEEWEE FOOTBALL BLOCKING AND TACKLING DUMMY

BACKGROUND OF THE INVENTION

The instant invention relates generally to football practice devices and more specifically it relates to a peewee blanket assembly for a football blocking and tackling dummy.

Numerous football practice devices have been provided in the prior art that are adapted to simulate the actual football game situation of blocking and tackling an opponent. For example, U.S. Pat. Nos. 3,464,696 to Hooker; 3,556,523 to Hooker and 3,659,847 to Gow all are illustrative of such prior art. While these units may be suitable for the particular purpose to which they address, they would not be as suitable for the purpose of the present invention as hereafter described.

SUMMARY OF THE INVENTION

A primary object of the present invention is to provide a peewee blanket assembly for a football blocking and tackling dummy that will overcome the shortcomings of the prior art devices.

Another object is to provide a peewee blanket assembly for a football blocking and tackling dummy which wraps around an existing tackling dummy to accomplish the task of teaching the user typically young boys the proper techniques of blocking and tackling in a low position.

An additional object is to provide a peewee blanket assembly for a football blocking and tackling dummy in which teams can use existing equipment and just add the blanket assembly which not only tells the athlete that he is striking the right target area, but also gives an indication as to the strength or force of the blow.

A further object is to provide a peewee blanket assembly for a football blocking and tackling dummy that is simple and easy to use.

A still further object is to provide a peewee blanket assembly for a football blocking and tackling dummy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims. BRIEF DESCRIPTION OF THE DRAWING FIGURES The figures in the drawings are briefly described as follows:

DETAILED DESCRIPTION OF THE PREFERRED EMBODIMENTS

Figure 1:
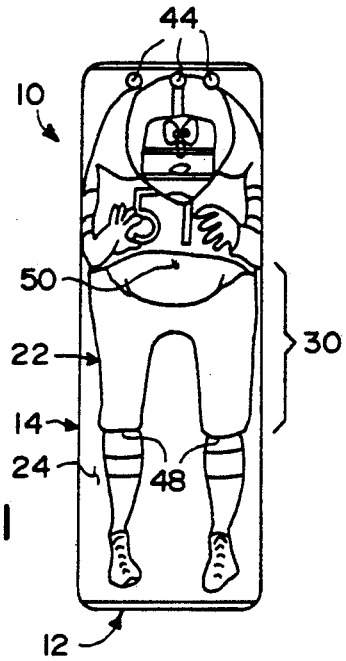
FIG. 1 is a front view showing the invention wrapped around an existing tackling dummy.
Figure 2:
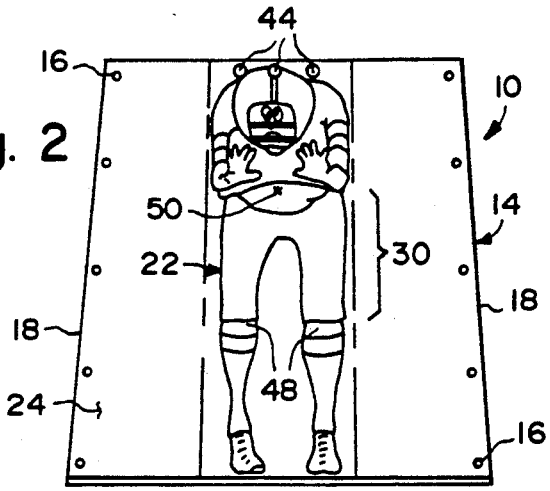
FIG. 2 is a front perspective view of the instant invention opened up and laid out flat.

Turning now descriptively to the drawings, in which similar reference characters denote similar elements throughout the several views, the Figures illustrate a peewee blanket assembly 10 for a football blocking and tackling dummy 12 which consists of a rectangular shaped blanket member 14 having a plurality of spaced apart eyelets 16 along each long side edge 18 thereof. A lacing cord 20 extend through the eyelets 16 on each opposite long side edge 18 so that the blanket member 14 can wrap around an existing tackling dummy 12. A full length standing picture 22 of a football player indicia is indicated in the middle on the front surface 24 of the blanket member 14. A mechanism 26 is within the middle rear surface 28 of the blanket member 14 for indicating the strength of force when a user tackles the blanket member 14 on the existing tackling dummy 12 properly in a target area 30.

A piece of flat foam rubber padding 32 is affixed to the middle rear surface 28 of the blanket member 14. A panel 34 is sized to fit over the piece of flat foam rubber padding 32 in the middle rear surface 28 of the blanket member 14. Hook and loop fabric fastener strips 36 are to removably attach the panel 34 over the piece of flat foam rubber padding 32. The blanket member 14 and the panel 34 are fabricated typically out of vinyl sheet material.

Figure 5:
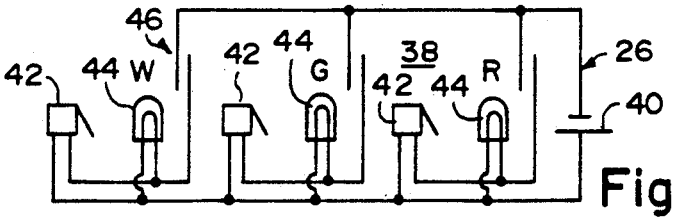
FIG. 5 is an electrical schematic diagram of the instant invention.
Figure 3:
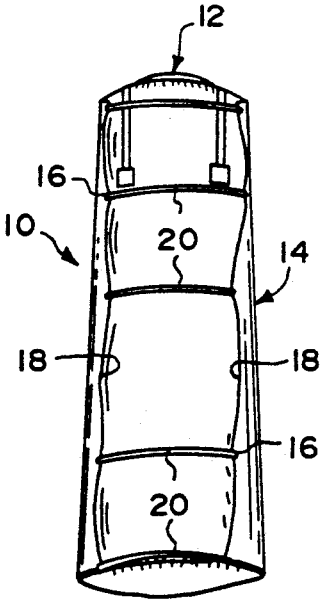
FIG. 3 is a rear perspective view showing the instant invention wrapped around the existing tackling dummy.
Figure 4:
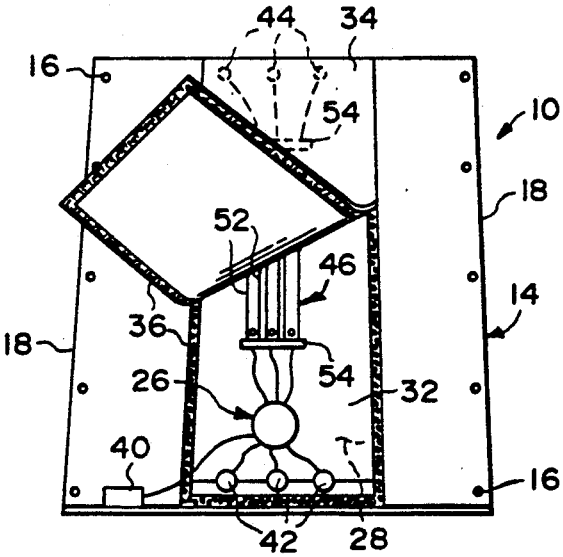
FIG. 4 is a rear perspective view of the instant invention opened up flat with the panel partly opened to show the sensing circuitry therein.

As best understood from FIG. 5, the indicating mechanism 26 is an electrical circuit 38 that includes a battery 40 to supply an electric current through the electrical circuit 38. A plurality of buzzers 42, are provided with each electrically connected to the electrical circuit 38 for making a buzzing sound. A plurality of lamps 44 of different colors are also provided, with each electrically connected to the electrical circuit 38 for illuminating light therefrom. A pressure sensitive switch set assembly 46 is electrically connected to the electrical circuit 38 between the battery 40, the plurality of buzzers 42 and the plurality of lamps 44 and is located on the piece of flat foam rubber padding 32 in the space between the knees 48 and belly button 50 of the picture 22 of the football player in the middle on the front surface 24 of the blanket member 14 defining the target area 30. The pressure sensitive switch assembly 46 includes multiple pairs of parallel vertical spring steel blades 52 supported between a pair of insulated cap ends 54 in which each pair of steel blades 52 are wired between the battery 40 and to one particular buzzer 42 and to one particular lamp 44 in the electrical circuit 38. If the user tackles the blocking dummy in the target area 30, each of the pressure sensitive switches in the switch set assembly 46 will close only when the tackling force exceeds a known particular amount of force for which that particular switch has been preset to close thus indicating to the user how hard a tackle had been achieved by causing the appropriate lights 44 to be activated.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A peewee blanket assembly for a football blocking and tackling dummy comprising:

a) a substantially rectangular blanket member having front and rear surfaces and a plurality of spaced apart eyelets along the long side edges thereof;

b) a lacing cord, which passes through the eyelets and extends between the eyelets on opposite said long side edges so that said blanket member can be wrapped around an existing tackling dummy;

c) a full length standing picture of a football player indicia in the middle on said front surface of said blanket member; and d) means attached to and centrally of said rear surface of said blanket member, for indicating the magnitude of force applied to said blanket when a user tackles said blanket member when on a blocking and tackling dummy and to indicate when said dummy is properly tackled i) said means attached to and centrally of said rear surface comprising, a piece of flat foam rubber padding ii) a panel sized to fit over said piece of; and iii) hook and loop fabric fastener strips permanently secured to said blanket member and said panel to removably attach said panel over said piece of flat foam rubber padding.

2. A peewee blanket assembly for a football blocking and tackling dummy as recited in claim 1, wherein said blanket member and said panel are fabricated out of vinyl sheet material.

3. A peewee blanket assembly for a football blocking and tackling dummy as recited in claim 2, wherein said indicating means is an electrical circuit that includes:

a) a battery to supply an electric current through said electrical circuit;

b) a plurality of buzzers, each electrically connected to said electrical circuit for making a momentary buzzing sound;

c) a plurality of lamps, each electrically connected to said electrical circuit for momentarily illuminating light therefrom; and d) a pressure sensitive switch set assembly electrically connected to said electrical circuit between said battery, said plurality of buzzers and said plurality of lamps and located on said piece of flat foam rubber padding in the space between the knees and belly button of said picture of a football players in the middle on the front surface of said blanket member defining the target area so that if a user tackles said dummy in the target area, each of the pressure sensitive switches in the switch set assembly will close only when the tackling force exceeds a known particular amount of force for which a particular switch in said switch set assembly has been preset to close thus indicating to the user how hard a tackle had been achieved by causing the appropriate lights to be momentarily activated.

4. A peewee blanket assembly for a football blocking and tackling dummy as recited in claim 3, wherein said pressure sensitive switch assembly includes multiple pairs of parallel vertical spring steel blades supported between a pair of insulated cap ends in which each said pair of steel blades are wired between said battery and one of said buzzers and one of said lamps in said electrical circuit.

* * * * *